US006239410B1

(12) United States Patent
Tackore

(10) Patent No.: US 6,239,410 B1
(45) Date of Patent: May 29, 2001

(54) GLOVE WITH INCORPORATED ADJUSTABLE HEATER

(76) Inventor: Allan Tackore, 1058 Southern Blvd., Bronx, NY (US) 10459

( * ) Notice: Subject to any disclaimer, the term of this patent is extended or adjusted under 35 U.S.C. 154(b) by 0 days.

(21) Appl. No.: 09/616,791

(22) Filed: Jul. 14, 2000

(51) Int. Cl.[7] ..... H05B 1/00
(52) U.S. Cl. ..... 219/211
(58) Field of Search ..... 219/211, 548, 219/549; 607/111

(56) References Cited

U.S. PATENT DOCUMENTS

| | | | | |
|---|---|---|---|---|
| 1,073,926 | * | 9/1913 | Pollak | 219/211 |
| 2,277,772 | * | 3/1942 | Marick | 219/211 |
| 2,298,298 | * | 10/1942 | Joy et al. | 219/211 |
| 2,718,584 | * | 9/1955 | Hariv | 219/535 |
| 3,748,436 | * | 7/1973 | Cossaboom | 219/211 |
| 3,989,924 | * | 11/1976 | Kurtzer | 219/211 |
| 5,032,705 | * | 7/1991 | Batcheller et al. | 219/211 |
| 5,148,002 | * | 9/1992 | Kuo et al. | 219/211 |
| 5,541,388 | * | 7/1996 | Gadd | 219/211 |
| 5,620,621 | * | 4/1997 | Sontag | 219/211 |
| 5,866,881 | * | 2/1999 | Jones, III | 219/527 |
| 6,049,062 | * | 4/2000 | Jones | 219/211 |
| 6,060,693 | * | 5/2000 | Brown | 219/211 |

* cited by examiner

*Primary Examiner*—Teresa Walberg
*Assistant Examiner*—Vinod D. Patel
(74) *Attorney, Agent, or Firm*—Goldstein & Canino

(57) ABSTRACT

A glove with incorporated adjustable heater including a glove portion adapted for receiving the person's hand therein. The glove portion is comprised of a padded interior layer and a waterproof outer layer. A flexible heating coil is disposed within the padded interior layer of the glove portion. The flexible heating coil is disposed within an entirety of the padded interior layer. The heating coil includes an adjustment dial disposed within the outer layer of the glove portion. A rechargeable battery is secured to the waterproof outer layer of the glove portion. The battery is in communication with the flexible heating coil. The battery includes a power indicating gauge.

4 Claims, 1 Drawing Sheet

GLOVE WITH INCORPORATED ADJUSTABLE HEATER

BACKGROUND OF THE INVENTION

The present invention relates to a glove with incorporated adjustable heater and more particularly pertains to keeping a person's hands warm during cold conditions.

The use of heated garments is known in the prior art. More specifically, heated garments heretofore devised and utilized for the purpose of heating the garment are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,764,665 to Orban et al. discloses electrically heated gloves. U.S. Pat. No. 4,950,868 to Moss et al. discloses heated gloves. U.S. Pat. No. 5,187,814 to Gold discloses a glove with attached heater pack. U.S. Pat. No. 5,302,807 to Zhao discloses an electrically heated garment with oscillator control for heating element. U.S. Pat. No. 5,032,705 to Batcheller et al. discloses an electrically heated garment. U.S. Pat. No. Des. 327,963 to Westlake discloses the ornamental design for a glove heater.

While these devices fulfill their respective, particular objective and requirements, the aforementioned patents do not describe a glove with incorporated adjustable heater for keeping a person's hands warm during cold conditions.

In this respect, the glove with incorporated adjustable heater according to the present invention substantially departs from the conventional concepts and designs of the prior art, and in doing so provides an apparatus primarily developed for the purpose of keeping a person's hands warm during cold conditions.

Therefore, it can be appreciated that there exists a continuing need for a new and improved glove with incorporated adjustable heater which can be used for keeping a person's hands warm during cold conditions. In this regard, the present invention substantially fulfills this need.

SUMMARY OF THE INVENTION

In the view of the foregoing disadvantages inherent in the known types of heated garments now present in the prior art, the present invention provides an improved glove with incorporated adjustable heater. As such, the general purpose of the present invention, which will be described subsequently in greater detail, is to provide a new and improved glove with incorporated adjustable heater which has all the advantages of the prior art and none of the disadvantages.

To attain this, the present invention essentially comprises a glove portion adapted for receiving the person's hand therein. The glove portion is comprised of a padded interior layer and a waterproof outer layer. A flexible heating coil is disposed within the padded interior layer of the glove portion. The flexible heating coil is disposed within an entirety of the padded interior layer. The heating coil includes an adjustment dial disposed within the outer layer of the glove portion. A rechargeable battery is secured to the waterproof outer layer of the glove portion. The battery is in communication with the flexible heating coil. The battery includes a power indicating gauge. A thermometer is secured to the waterproof outer layer of the glove portion. The thermometer monitors an outside temperature. The thermometer is in communication with the rechargeable battery.

An adjustable wrist band is secured to the glove portion. The adjustable wrist band serves to secure the glove portion to the person's hand.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glove with incorporated adjustable heater which has all the advantages of the prior art heated garments and none of the disadvantages.

It is another object of the present invention to provide a new and improved glove with incorporated adjustable heater which may be easily and efficiently manufactured and marketed.

It is a further object of the present invention to provide a new and improved glove with incorporated adjustable heater which is of durable and reliable construction.

An even further object of the present invention is to provide a new and improved glove with incorporated adjustable heater which is susceptible of a low cost of manufacture with regard to both materials and labor, and which accordingly is then susceptible of low prices of sale to the consuming public, thereby making such a glove with incorporated adjustable heater economically available to the buying public.

Even still another object of the present invention is to provide a new and improved glove with incorporated adjustable heater for keeping a person's hands warm during cold conditions.

Lastly, it is an object of the present invention to provide a new and improved glove with incorporated adjustable heater including a glove portion adapted for receiving the person's hand therein. The glove portion is comprised of a padded interior layer and a waterproof outer layer. A flexible heating coil is disposed within the padded interior layer of the glove portion. The flexible heating coil is disposed within an entirety of the padded interior layer. The heating coil includes an adjustment dial disposed within the outer layer of the glove portion. A rechargeable battery is secured to the waterproof outer layer of the glove portion. The battery is in communication with the flexible heating coil. The battery includes a power indicating gauge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figures 1, 2:
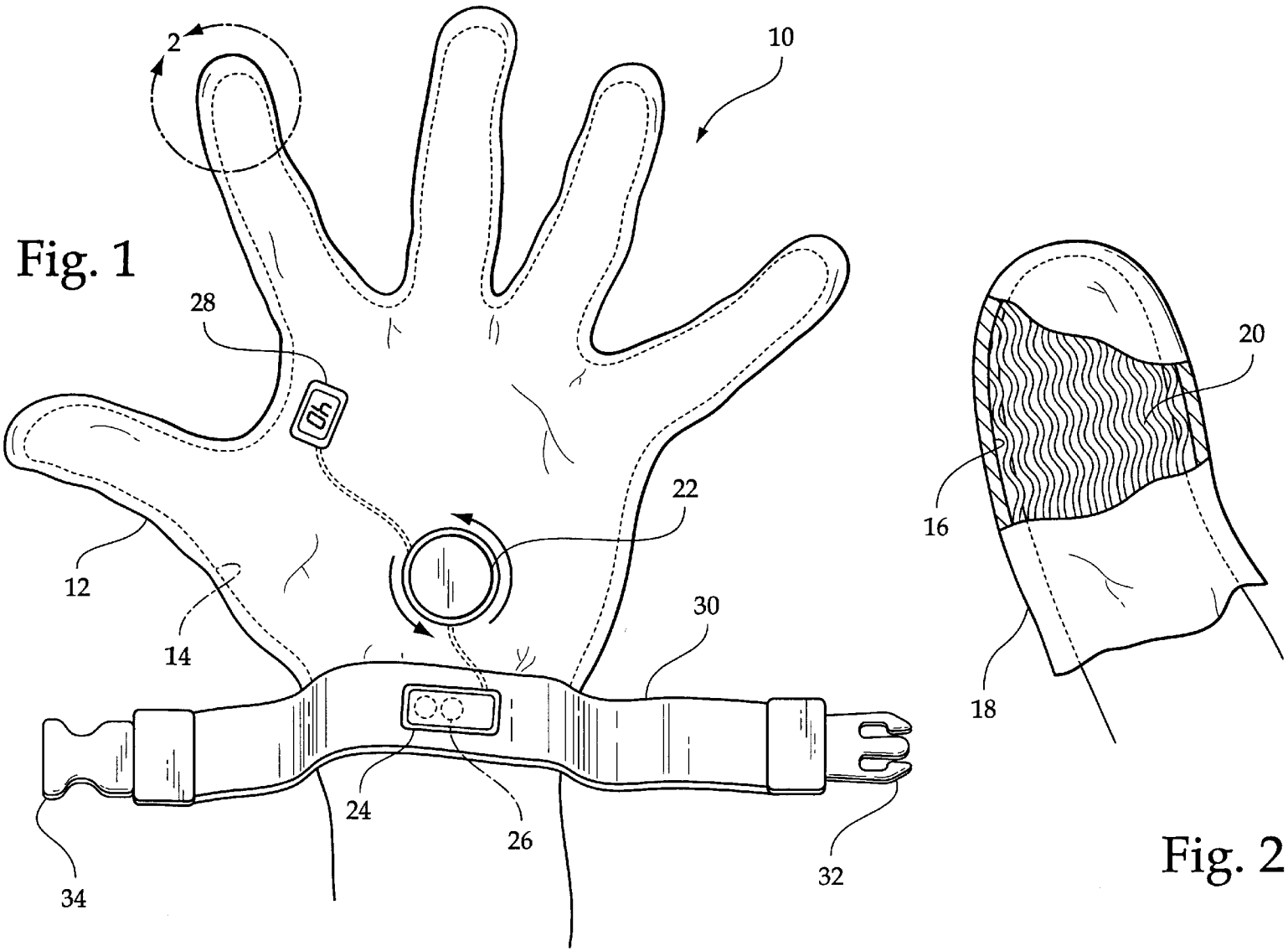
FIG. 1 is a perspective view of the preferred embodiment of the glove with incorporated adjustable heater constructed in accordance with the principles of the present invention.
FIG. 2 is a sectional perspective view of the present invention.

With reference now to the drawings, and in particular, to FIGS. 1 and 2 thereof, the preferred embodiment of the new and improved glove with incorporated adjustable heater embodying the principles and concepts of the present invention and generally designated by the reference number 10 will be described.

Specifically, it will be noted in the various figures that the device relates to a glove with incorporated adjustable heater for keeping a person's hands warm during cold conditions. In its broadest context, the device consists of a glove portion, a flexible heating coil, a rechargeable battery, a thermometer, and an adjustable wrist band. Such components are individually configured and correlated with respect to each other so as to attain the desired objective.

The glove portion 12 is adapted for receiving the person's hand 14 therein. The glove portion 12 is comprised of a padded interior layer 16 and a waterproof outer layer 18. The glove portion 12, as illustrated in FIGS. 1 and 2, is provided with individual finger compartments. It should be noted, however, that the glove portion 12 could be constructed as a mitten.

The flexible heating coil 20 is disposed within the padded interior layer 16 of the glove portion 12. Note FIG. 2. The flexible heating coil 20 is disposed within an entirety of the padded interior layer 16. This will allow the heating coil 20 to warm the persons's entire hand. The heating coil 20 includes an adjustment dial 22 disposed within the outer layer 18 of the glove portion 12. The adjustment dial 22 will allow an amount of heat produced by the heating coil 20 to be adjusted according to the needs of the person wearing the present invention.

The rechargeable battery 24 is secured to the waterproof outer layer 18 of the glove portion 12. The battery 24 is in communication with the flexible heating coil 20. The battery 24 includes a power indicating gauge 26. The gauge 26 will allow the person to know how much longer they can use the present invention without having to recharge the battery 24. The present invention will also be provided with an adapter for the battery 24 so as to recharge the battery 24 through the use of an electrical outlet. The battery 24 would be provided with a port or the like to couple with the adapter.

The thermometer 28 is secured to the waterproof outer layer 18 of the glove portion 12. The thermometer 28 monitors an outside temperature. Alternately, the thermometer 28 could be used to monitor the temperature of the heating coil 20. The thermometer 28 is in communication with the rechargeable battery 24.

The adjustable wrist band 30 is secured to the glove portion 12. The adjustable wrist band 30 serves to secure the glove portion 12 to the person's hand 14. The wrist band 30 is preferably constructed of an elastic material to allow for proper stretching. As illustrated in FIG. 1, the wrist band 30 is provided with opposed male and female latching members 32,34 to better secure the glove portion 12 to the person's hand 14.

The present invention could also be provided with a carrying case that could store the glove portion 12 when not in use, or while the battery 24 is being recharged.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A glove with incorporated adjustable heater for keeping a person's hands warm during cold conditions comprising, in combination:

a glove portion adapted for receiving the person's hand therein, the glove portion being comprised of a padded interior layer and a waterproof outer layer;

a flexible heating coil disposed within the padded interior layer of the glove portion, the flexible heating coil being disposed within an entirety of the padded interior layer, the heating coil including an adjustment dial disposed within the outer layer of the glove portion;

a rechargeable battery secured to the waterproof outer layer of the glove portion, the battery being in communication with the flexible heating coil, the battery including a power indicating gauge;

a thermometer secured to the waterproof outer layer of the glove portion, the thermometer monitoring an outside temperature, the thermometer being in communication with the rechargeable battery; and an adjustable wrist band secured to the glove portion, the adjustable wrist band serving to secure the glove portion to the person's hand.

2. A glove with incorporated adjustable heater for keeping a person's hands warm during cold conditions comprising, in combination:

a glove portion adapted for receiving the person's hand therein, the glove portion being comprised of a padded interior layer and a waterproof outer layer;

a flexible heating coil disposed within the padded interior layer of the glove portion, the flexible heating coil being disposed within an entirety of the padded interior layer, the heating coil including an adjustment dial disposed within the outer layer of the glove portion; and a rechargeable battery secured to the waterproof outer layer of the glove portion, the battery being in communication with the flexible heating coil, the battery including a power indicating gauge.

3. The glove with incorporated adjustable heater as set forth in claim 2, and further including a thermometer secured to the waterproof outer layer of the glove portion, the thermometer monitoring an outside temperature, the thermometer being in communication with the rechargeable battery.

4. The glove with incorporated adjustable heater as set forth in claim 2, and further including an adjustable wrist band secured to the glove portion, the adjustable wrist band serving to secure the glove portion to the person's hand.

* * * * *